United States Patent [19]

Adams et al.

[11] Patent Number: 4,642,176

[45] Date of Patent: Feb. 10, 1987

[54] CATALYTIC DEWAXING PROCESS

[75] Inventors: Priscilla L. Adams, Langhorne, Pa.; Malvina Farcasiu, Flemington, N.J.

[73] Assignee: Mobil Oil Corporation, New York, N.Y.

[21] Appl. No.: 690,083

[22] Filed: Jan. 9, 1985

[51] Int. Cl.[4] ..... C10G 45/08; C10G 47/20

[52] U.S. Cl. ..... 208/111; 208/216 R; 208/217

[58] Field of Search ..... 208/111, 216 R, 217, 208/213

[56] References Cited

U.S. PATENT DOCUMENTS

| | | | |
|---|---|---|---|
| 3,968,024 | 7/1976 | Gorring et al. | 208/111 |
| 3,989,617 | 11/1976 | Yan | 208/87 |
| 4,229,282 | 10/1980 | Peters et al. | 208/111 |
| 4,395,327 | 7/1983 | Pelrine | 208/216 R |
| 4,428,862 | 1/1984 | Ward et al. | 502/77 |
| 4,431,519 | 2/1984 | LaPierre et al. | 208/111 |

*Primary Examiner*—Brian E. Hearn
*Assistant Examiner*—O. Chaudhuri
*Attorney, Agent, or Firm*—A. J. McKillop; M. G. Gilman; M. V. Schneller

[57] ABSTRACT

An improved hydrodewaxing process which produces a dewaxed feedstock having a pour point of at least minimum specification and also eliminates the need for conventional hydrotreating subsequent to hydrodewaxing to render the dewaxed stock stable to light and oxidation and to reduce the aging rate of the catalyst is described and includes catalytically hydrodewaxing the feedstock under conditions equivalent to a pressure of about 400 psig, a maximum temperature of about 620° F. and a maximum space velocity of 1.0 LHSV, in the presence of a catalyst comprising a zeolite and a metal of Group VIII alone or admixed with an element of Group VI.

14 Claims, 1 Drawing Figure

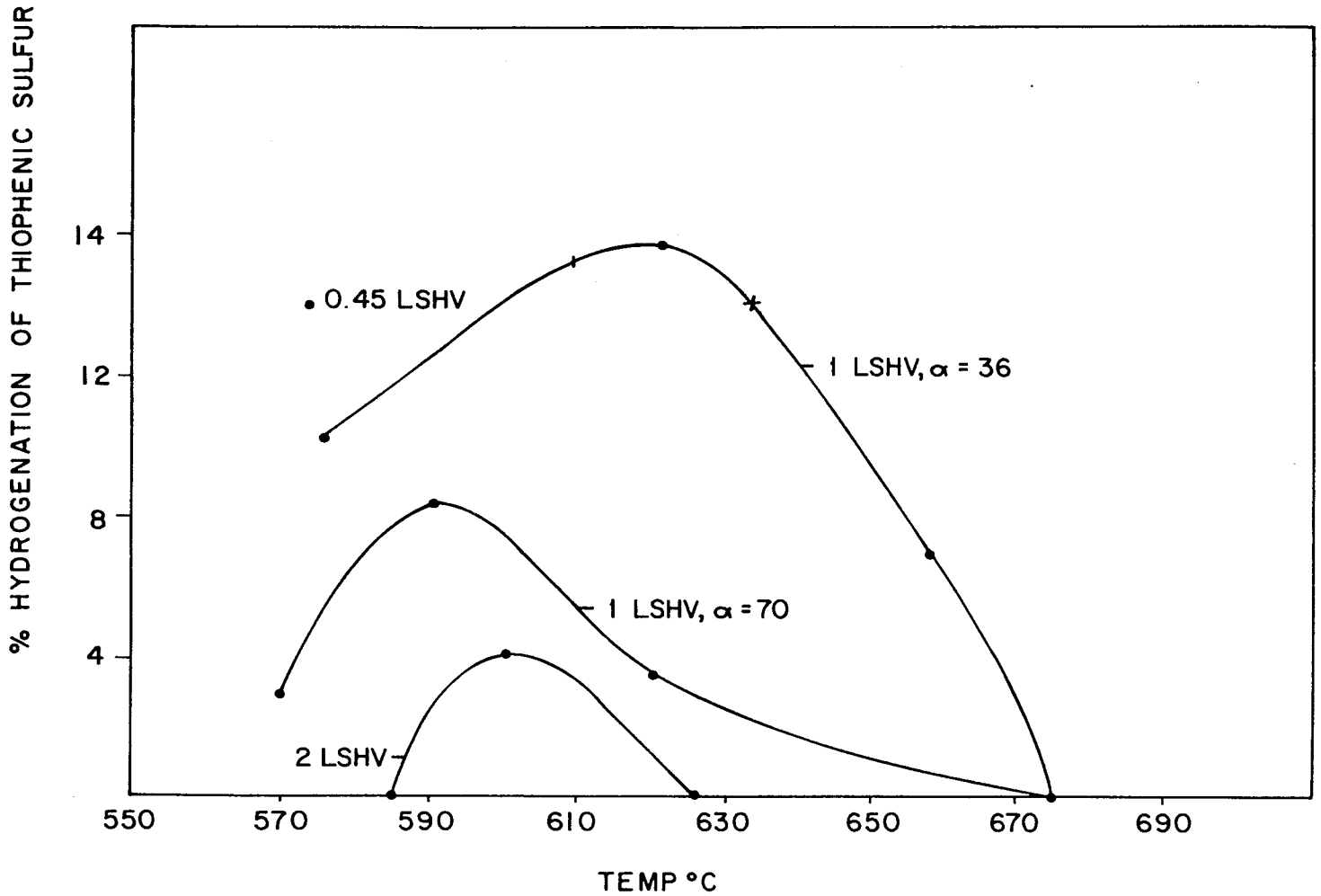
% HYDROGENATION OF THIOPHENIC SULFUR
14
12
8
4
550
570
590
610
630
650
670
690
TEMP °C
• 0.45 LSHV
1 LSHV, α = 36
1 LSHV, α = 70
2 LSHV

CATALYTIC DEWAXING PROCESS

BACKGROUND OF THE INVENTION

1. Field of the Invention

The invention is directed to an improved hydrodewaxing process, whereby the effluent from the hydrodewaxing unit, in addition to having acceptable pour point specifications also exhibits oxidative stability as measured by ASTM D-943.

2. Prior Art

Because lubricating oils for the most part are based on petroleum fractions boiling above about 230° C. (450° F.), the molecular weight of the hydrocarbon constituents is high and these constituents display almost all conceivable structures and structure types. The complexity of the molecular constitution of lubricating oils and its consequences are referred to in "Petroleum Refinery Engineering", by W. L. Nelson, McGraw Hill Book Company, Inc., New York, N.Y., 1958 (Fourth Edition), relevant portions of this text being incorporated herein by reference, for background.

Although the broad principles involved in refining are qualitatively understood, the art is encumbered by quantitative uncertainties which require considerable resort to empiricism in practical refining. Underlying these quantitative uncertainties is the complexity of the molecular constitution of lubricating oils. Accordingly, the art of refining suitable petroleum crude oils to obtain a variety of lubricating oils which function effectively in diverse environments has become highly developed and complex.

In general, the basic notion in lubricant refining is that a suitable crude oil, as shown by experience or by assay, contains a quantity of lubricant stock having a predetermined set of properties such as, for example, appropriate viscosity, oxidation stability, and maintenance of fluidity at low temperatures. The process of refining to isolate that lubricant stock consists of a set of subtractive unit operations which removes the unwanted components. The most important of these unit operations include distillation, solvent refining, and dewaxing, which basically are physical separation processes in the sense that if all the separated functions were recombined, one would constitute the crude oil.

Lubricating oil stocks generally have an unacceptably high pour point and thus require dewaxing. Solvent dewaxing is a well-known and effective process but expensive. More recently catalytic methods for dewaxing have been proposed. U.S. Pat. No. Re. 28,398 describes a catalytic dewaxing process wherein a particular crystalline zeolite is used. U.S. Pat. Nos. 4,283,271, 4,283,272 and 4,414,097 describe processes for producing dewaxed lubricating oil base including hydrocracking a hydrocarbon feedstock, catalytically dewaxing the hydrocrackate and hydrotreating the dewaxed hydrocrackate. These latter patents, recognized as advances in the art, describe use of catalyst compositions comprising zeolite ZSM-5, ZSM-11 and ZSM-23 for the dewaxing phase. To obtain lubricants and specialty oils with outstanding resistance to oxidation, it is often necessary to hydrotreat the oil after catalytic dewaxing, as illustrated by U.S. Pat. No. 4,137,148. The foregoing patents indicate the state of the dewaxing art and are incorporated herein by reference as background.

As indicated above, the prior art processes include a hydrotreating stage subsequent to hydrodewaxing. Although hydrodewaxing produces effluents of acceptable pour point and viscosity index specification, the same effluents may be unstable to air and/or to light. The object of the hydrotreating step, after hydrodewaxing, is to remove by hydrogenation those components of the dewaxed effluent which were unstable to oxidation conditions, unstable to air and light.

The hydrotreating operation can include passing the dewaxed effluent to a hydrotreater unit. The hydrotreater unit contains a hydrotreating catalyst in a hydrotreating zone at stabilizing conditions. Examples of hydrotreating catalysts include, without limitation, one or more metals from Group VIII (e.g., cobalt and nickel) and Group VI (e.g., molybdenum and tungsten) of the Periodic Table of Elements supported by an inorganic oxide such as, for example, alumina or silica-alumina. Conditions in the hydrotreater unit are summarized in Table I.

TABLE I

| | Hydrotreating Conditions |
|---|---|
| Pressure, broad, psig | 400–3000 |
| Pressure, preferred, psig | 400–2500 |
| Temperature, broad, °C. | 176–371 |
| Temperature, preferred, °C. | 204–316 |
| LHSV,* broad | 0.1–10 |
| LHSV, preferred | 0.2–3 |
| $H_2$ gas, SCF/bbl, broad | 500–20,000 |
| $H_2$ gas, SCF/bbl, preferred | 500–3000 |

It is an object of the invention to eliminate the necessity of the additional hydrotreating operation in producing hydrodewaxed effluents which are stable to oxidation by air and/or by light. It is thus an object of the invention to provide a hydrodewaxing operation which results in a hydrodewaxed effluent which is stable to air and to light.

SUMMARY OF THE INVENTION

The hydrotreating step which is eliminated in accordance with the invention was employed in the prior art to treat dewaxed fractions, otherwise having acceptable pour point and viscosity index specifications, to increase the oxidative stability of the dewaxed fractions. The catalysts used in the hydrodewaxing step, exhibit activity in hydrogenating thiophenic sulfur and olefins. That activity parallels one of the functions of the hydrotreating catalyst in the hydrotreating (sometimes referred as the "hydrofinishing") stage.

The invention provides a dewaxing process in which the hydrogenative activity of the hydrodewaxing catalyst is sustained. In this process, the hydrodewaxing stage is conducted in the presence of a catalyst comprising a zeolite, a hydrogenative metal deposited, admixed or ion exchanged on the zeolite, and usually a binder or matrix, and at a temperature and space velocity (LHSV, which is the liquid hourly space velocity, i.e., volumes of feed per hour per volume of catalyst) whereby the hydrogenative activity of the dewaxing catalyst is optimized. The advantages of the invention reside in economies of energy and time. Moreover, the process results in reduced aging of the catalyst.

BRIEF DESCRIPTION OF THE DRAWING

The drawing is a graph of the plot of % hydrogenation of thiophenic sulfur v. temperature.

DETAILED DESCRIPTION OF THE INVENTION

Feedstocks having boiling points above about 550° F. are hydrodewaxed in accordance with the invention. In embodiments described below, the feedstock is the oil resulting from deasphalting vacuum resids and remaining in the raffinate in furfural extraction after deasphalting.

The feedstock is passed to a catalytic dewaxing unit along with makeup hydrogen. The amount of hydrogen supplied may be up to about the amount consumed in the process. The prior art process conditions in the catalytic hydrodewaxing unit are summarized in Table II:

TABLE II

| | Dewaxing Conditions |
|---|---|
| Pressure, broad, psig | 200–3000 |
| Pressure, preferred, psig | 400–2500 |
| Temperature, broad, °C. | 260–482 |
| Temperature, preferred, °C. | 343–427 |
| LHSV,* broad | 0.2–20 |
| LHSV, preferred | 0.5–5 |
| $H_2$ gas, SCF/bbl,** broad | 500–20,000 |
| $H_2$ gas, SCF/bbl, preferred | 500–3000 |

*LHSV = liquid hourly space velocity, i.e., volumes of feed per volume of catalyst per hour
**SCF/bbl = standard cubic feet per barrel In accordance with the invention, the catalytic hydrodewaxing process can be continually optimized by analyzing the degree of the hydrogenation of the thiophenic sulfur and by maintaining conditions which will ensure at least 10% hydrogenation of the thiophenic sulfur in the feed subjected to hydrodewaxing. In one embodiment of the invention, it was discovered that by maintaining a constant pressure during hydrodewaxing, catalyzed by compositions described below, and thereby eliminating pressure as a variable, the hydrogenative activity of the catalyst could be maximized by employing a maximum LHSV of about 1 and a temperature of less than about 620° F., and thereby elimination of the hydrotreating stage could be realized.

The catalyst used in the hydrodewaxing unit will comprise a zeolite, a metal which is a hydrogenation component and usually a binder matrix, or support material.

The zeolite component of the catalyst can be used in the organic nitrogen-containing form, an alkali metal-containing form, the hydrogen form or another univalent or multivalent cationic form. The as-synthesized zeolite may be conveniently converted into the hydrogen, the univalent or multivalent cationic forms by base exchanging the zeolite to remove the sodium cations by such ion as hydrogen (from acids), ammonium, alkylammonium and arylammonium including $RNH_3R_3NH^+$, $R_2NH_2$ and $R_4N^+$ where R is alkyl or aryl, provided that steric hindrance does not prevent the cations from entering the cage and cavity structure of the zeolite. The hydrogen form of the zeolite is prepared, for example, by base exchanging the sodium form with, e.g., ammonium chloride or hydroxide whereby the ammonium ion is substituted for the sodium ion. The composition is then calcined at a temperature of, e.g., 1000° F. (about 540° C.) causing evolution of ammonia and retention of the hydrogen proton in the composition. Other replacing cations include cations of the metals of the Periodic Table, particularly metals other than sodium, most preferably metals of Group IIA, e.g., zinc, and Groups IIIA, IVA, IB, IIB, IIIB, IVB, VIB and Group VIII of the Periodic Table, and rare earth metals and manganese.

Ion exchange of the zeolite can be accomplished conventionally, e.g., by admixing the zeolite with a solution of a cation to be introduced into the zeolite. Ion exchange with various metallic and non-metallic cations can be carried out according to the procedures described in U.S. Pat. Nos. 3,140,251, 3,140,252 and 3,140,253, the entire contents of which are incorporated herein by reference.

The Group VIII metal component of the catalyst composition can be exchanged into the composition, impregnated therein or physically and intimately admixed therewith. Ion exchange can be carried out according to procedures described in U.S. Pat. Nos. 3,140,251, 3,140,252 and 3,140,253, the entire contents of which are incorporated by reference herein. Impregnation may be effected by treating the zeolite with a solution containing a Group VIII metal- or a Group VIII metal-containing ion. The amount of Group VIII metal in the catalyst composition can range from about 0.1 to about 3 weight percent, preferably from about 0.2 to about 1 weight percent, based on the total weight of the catalyst composition. The Group VIII metal component can be platinum, palladium, iridium, ruthenium, cobalt, nickel and mixtures thereof. In a preferred embodiment the Group VIII metal is nickel. Although nickel is the most preferred Group VIII metal used in the catalyst composition, it is contemplated that a Group VIII metal other than nickel, can be used to replace it at least in part in the catalyst composition; the preferred Group VIII metal component replacing nickel is one which effects a result equivalent to nickel in combination with the zeolite of the catalyst composition of the invention. The Group VIII metal component of the composition may be used alone or in combination with a metal from Group VI of the Periodic Table of Elements. Examples of metals of Group VI are chromium, molybdenum, tungsten and mixtures thereof.

The catalyst composition comprising the zeolite dewaxing catalyst component and Group VIII metal(s) includes a support material which is matrix or binder component comprising a material resistant to the temperature or other process conditions.

Useful matrix materials include both synthetic and naturally occurring substances, as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee, Georgia and Florida clays or others in which the main mineral constituent is halloysite, kaolinite, nacrite or anauxite. Such clays can be used in the raw state as originally mined or initially subjected to calcination, acid treatment or chemical modification.

In addition to the foregoing materials, the zeolite employed herein may be composited with a porous matrix material, such as alumina, silica-alumina, silica-magnesia, silica-zirconia, silica-thoria, silica-beryllia, silica-titania as well as ternary compositions such as silica-alumina-thoria, silica-alumina-zirconia, silica-alumina-magnesia and silica-magnesia-zirconia. The matrix can be in the form of a cogel.

The relative proportions of zeolite component and Group VIII metal and support material on an anhydrous basis, may vary widely. So that the zeolite comprises up to 99% of the catalyst composition, the support material content will generally range from about 20 to about 50 percent by weight and is more usually in the range of about 25 to about 45 percent by weight of the dry composite; preferably the support comprises 30 to 40 percent by weight of the dried composite. The preferred supports of the catalyst composition are alumina, silica and silica-alumina. The Group VIII component associated with the zeolite may be on the zeolite component as above-noted or on the matrix component or both.

In studies directed to the activity of zeolite-containing hydrodewaxing catalysts, it was discovered that the hydrocracking activity of such catalysts remained at least substantially constant during hydrodewaxing; that is, variation of the cracking activity of the catalyst is quite small. However, it appears that the hydrogenative activity of the catalyst increases, then reaches a maximum and subsequently decreases with time on stream and with increasing dewaxing temperature, during hydrodewaxing.

Hydrogenation of olefins, of hydrodewaxing products, as well as hydrogenation of thiophenic sulfur containing compounds, can occur during hydrodewaxing. However, we have studied the extent of, and change in, hydrogenation of thiophenic sulfur during hydrodewaxing. We have discovered that hydrogenation of the thiophenic sulfur containing compounds can be used as an indicator in optimizing hydrodewaxing efficiency to thereby eliminate subsequent hydrotreating (or hydrofinishing) of the dewaxed products. Specifically, elimination of a subsequent hydrotreating step is achieved by monitoring conditions of temperature, pressure and LHSV which will ensure at least about 10% hydrogenation of the thiophenic sulfur. The method used to determine the percent of hydrogenation of thiophenic sulfur containing compounds is described in the experimental section below.

In a specific series of experiments, directed to the hydrogenative activity of a catalyst comprising 0.1 to 5.0 weight percent nickel, 65 weight percent ZSM-5 and 35 weight percent alumina, it was determined that at constant pressure, control of temperature and LHSV during hydrodewaxing could produce dewaxed products of acceptable oxidative stability, as measured by ASTM D-943, with acceptable pour point and viscosity specification, without undertaking the subsequent hydrotreating step. The results of these experiments are summarized in Table IV:

TABLE IV

Hydrogenative Activity of Ni—ZSM-5 in MLDW Process for Dewaxing of a Bright Stock

| Catalyst | Temperature °F. | Space Velocity LHSV | % Hydrogenation Thiophenic Sulfur |
|---|---|---|---|
| H—ZSM-5 | 597 | 2 | 0 |
| Ni—ZSM-5 | 599 | 2 | 4.1 |
| Ni—ZSM-5 | 590 | 1 | 12.8 |
| Ni—ZSM-5 | 573 | 0.45 | 12.8 |

These experiments indicate that for a nickel-ZSM-5 containing catalyst at a temperature maximum of around 600° to 610° F., the optimal maximum LHSV is around 1.0 at 400 psig. The nickel-ZSM-5 catalyst was a commercial one containing about 1.0–1.1% (by weight) nickel, 65 weight percent ZSM-5 and 35 weight percent alumina.

A sample of the dewaxed oil (obtained at 580°–600° F. and 1 LHSV) was analyzed for the oxidative stability by the TOST test. The data for that sample and another sample obtained in the usual dewaxing process are given in Table V.

TABLE V

TOST Test for a Dewaxed Bright Stock

| Sample | TOST Test* (hours) | Pour Point, °F. |
|---|---|---|
| Raffinate | 973 | 120 |
| MLDW dewaxed product before hydrofinishing | 774 | 10 |
| MLDW dewaxed and then hydrofinished product | 1284 (1568) | 15 |
| Solvent dewaxed | 1229 | 20 |
| MLDW dewaxed according to process of invention (no hydrofinishing) | 1302** | 15–20 |

*Minimum specification TOST 1000 hours. (ASTM D-943)

**The sample tested was that corresponding to the point in the curve of the drawing representing one of about 14% hydrogenation of thiophenic sulfur at LHSV of 1 and (alpha activity of catalyst) of 36.

EXPERIMENTAL

In order to trace the fate of sulfur compounds during hydrodewaxing, a chromatographic method was developed. The method used model compounds, the structures of which were chosen to be at least similar to components of dewaxing feeds and products. These compounds are set forth in Table VI.

TABLE VI

LC* Separation of the Model Compound Mixture

| Fraction No. | Model Compounds Present |
|---|---|
| I | $nC_{12}H_{26}$ |
| | 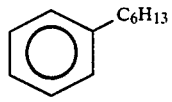 |
| | 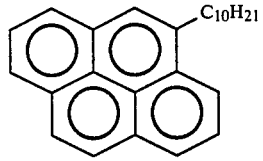 |
| | 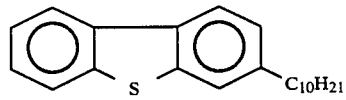 |
| | 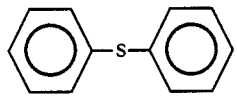 |
| II | $(nC_8H_{17})_2S + C_6H_5CH_2SC_6H_5$ |
| III | 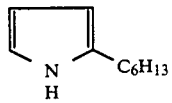 |

TABLE VI-continued

| LC* Separation of the Model Compound Mixture | |
|---|---|
| Fraction No. | Model Compounds Present |
| IV | 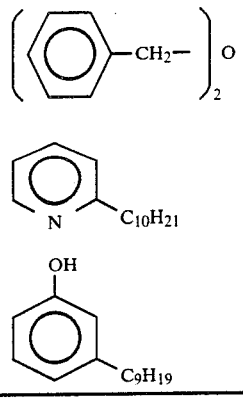 |

*LC refers to liquid chromatograph

The chromatography is performed over Woelm Silica 63-200 silica gel with a ratio of 1:30 by weight sample:silica gel with the following sequence of solvents:

TABLE A

| Fraction | Solvent | ~no bed volumes |
|---|---|---|
| I | Cyclohexane* | 4–5 |
| II | $CCl_4$** | 4–5 |
| III | $CHCl_3$** | 4–5 |
| IV | 10% $Et_2O/CHCl_3$** | 4–5 |
| V | 10% $MeOH/CHCl_3$** | 4–5 |

*Aldrich 99+% Spectrophotometric Cyclohexane
**All solvents were first percolated over Woelm Alumina B-Super 1.

Adsorption of the respective compounds in Table VI corresponds to Fractions designated in Table A. These fractions in Table A can be further identified, that is, the separation scheme achieves fractionation of the dewaxing feeds for dewaxing into the following classes of substances:

| Liquid chromatographic fraction | Major components |
|---|---|
| Fraction I<br>85–90 wt % of feed or products | Hydrocarbons (saturated and aromatic), thiophenic sulfur diaryl sulphide compounds and furanic oxygen compounds |
| Fraction II<br>6–14 wt % of feed or products | Alkyl and alkyl aromatic sulphides |
| Fraction III<br>1 wt % of feed or products | Nonbasic nitrogen compounds and ethers |
| Fraction IV<br>1 wt % of feed or products | Basic nitrogen compounds and phenols |
| Fraction V | Polyfunctional compounds |

-continued

| Liquid chromatographic fraction | Major components |
|---|---|
| 1 wt % of feed or product | N, O, S |

Fraction I does not contain nitrogen compounds. This was verified both for bright stocks (−200 ppm N in all samples) and topped Alaskan oil (−1840 ppm N in all samples). The nitrogen content is rather low in Fraction II (−100 ppm N) and high in the polar Fractions III–V (3000–5700 ppm N).

The major components in Fraction II are aliphatic and alkyl aromatic sulphides. The sulfur content of Fraction II in bright stocks and dewaxed products is >3.2% and is consistent with at least one sulfur atom in each molecule (average molecular weight 1000). The lower hydrogen content of Fraction II (−11%) as compared with Fraction I (−13%) (See Table B) may indicate that the majority of the sulphides contain aromatic substituents.

Employing the results of the chromatography of the model compounds as a standard, a feed was analyzed by the liquid chromatography, the results of which are summarized in Table B:

TABLE B

| Analyses of Paulsboro Bright Stock | | | | | | | |
|---|---|---|---|---|---|---|---|
| | | | Elemental Analysis | | | | |
| Sample | Solvent | % of Initial | (%) C | (%) H | (ppm) N | (%) O | (%) S |
| Paulsboro Bright Stock | Initial | 100% | 86.01 | 13.03 | 200 | 0.060 | 1.23 |
| MLDW Feed | | | | | | | |
| Fraction I | Cyclohexane | 85.60 | 85.76 | 13.27 | 0.00 | | 0.95 |
| Fraction II | Carbon Tet. | 7.35 | 83.90 | 11.44 | 144 | | |
| Fraction III | Chloroform | 3.40 | 85.89 | 12.02 | 3000* | 2.00* | 3.69* |
| Fraction IV | 10% Et20/CHC13 | 1.81 | 80.35* | 11.71* | 4600* | 3.25* | 2.80* |
| Fraction V | 10% MeOH/CHCl3 | 1.84 | | | 5700* | 4.68* | |

*Analysis by Galbraith Laboratories

The concentration of the thiophenic sulfur compounds and diarylsulphides in the feed can be calculated. The calculation is based on the following data: (a) the sulfur content of Fraction I in feed (1.27%S) (b) the percent Fraction I in feed (90.5%) and (c) an average molecular weight of 1000 for the feed molecules. This calculation indicates a concentration of 35.9 wt% thiophenic compounds and diaryl sulphides in the Adelaide Bright Stock.

The percent of thiophenic compounds in those feedstocks hydrogenated to sulphides was calculated as follows:

$$\% \text{ hydrogenation thiophenic compounds} = \frac{\Delta}{35.9} \times 100$$

where $\Delta \times$ wt% Fraction II in the product − wt% Fraction II in feed 35.9 = wt% thiophenic compounds in the feed We also calculated the percent of hydrocracking of Fraction I during dewaxing:

$$\% \text{ hydrocracking Fraction I} = \frac{\text{wt \% Fraction I feed} - \text{wt \% Fraction I product} - \Delta}{\text{wt \% Fraction I feed}}$$

To see if the composition of the dewaxed products varies with catalyst aging and or temperature, a simplified method to analyze samples of dewaxed products obtained at different on stream times (temperatures) in the dewaxing cycle was used. In the simplified method, only Fractions I and II are run and Fractions III–V are then determined by difference. The samples were obtained from experiments with Adelaide Bright Stock and Ni ZSM-5 catalysts with $\alpha=36$ and $\alpha=70$ (5).

In Tables C and D the results of the liquid chromatographic analyses are given together with relevant information about the dewaxing runs (temperature, days on stream, pour point, percent 750+F. recovery). To eliminate any confusion, we will refer in the following discussion to the concentration of different LC (liquid chromatography) fractions as percent of the initial feed (see Table C and D).

The additional amount of sulphides formed during dewaxing cannot have another source but Fraction I. In this case the additional amount of Fraction II are formed during the dewaxing process can be a measure of the hydrogenative ability of the catalyst.

The LC (liquid chromatography) results in Tables C and D allowed calculation of the % hydrogenation of thiophenic compounds and of the % hydrocracking Fraction I in accordance with the equations set forth above in the EXPERIMENTAL section:

| Days on Stream | Temp °F. | % hydrogenation thiophenic sulfur | % hydrocracking Fraction I | (A)/(B) |
|---|---|---|---|---|
| | | Table C ($\alpha$ = 36) | (B) | |
| 2.7 | 675 | 10.3 | 12.5 | 0.82 |
| 6.7 | 620 | 13.9 | 15.4 | 0.90 |
| 10.7 | 658 | 7.0 | 13.4 | 0.52 |
| 11.7 | 675 | 0 | 14.6 | 0 |
| | | Table D ($\alpha$ = 70) | | |
| 1.3 | 570 | 3 | 13.8 | 0.22 |
| 5.5 | 590 | 8.3 | 13.8 | 0.60 |
| 12.3 | 620 | 3.6 | 12.8 | 0.28 |
| 21.3 | 675 | 0 | 15.1 | 0 |

TABLE C

Analysis of Adelaide Bright Stock and Dewaxed Products From Hydrodewaxing Adelaide Bright Stock Over NiZSM-5 Catalyst $\alpha$ = 36 (5)

| Sample | Temp at Which the Product Was Obtained °F. | Pour Point °F. | 750° F. + % of Feed | LC Fraction I: % of 750° F. + Fraction | LC Fraction I: % of the Feed | LC Fraction II: % of 750° F. + Fraction | LC Fraction II: % of the Feed | LC *Fraction III-V: % of 750° F. + Fraction | LC *Fraction III-V: % of the Feed |
|---|---|---|---|---|---|---|---|---|---|
| Adelaide Bright Stock | — | 120° F. | 100 | 90.5 | 90.5 | 6.6 | 6.6 | 2.9 | 2.9 |
| Hydrodewaxed Sample Day 2.7 | 575° F. | 25° F. | 87.0 | 86.8 | 75.5 | 11.8 | 10.3 | 1.4 | 1.2 |
| Hydrodewaxed Sample Day 6.7 | 620° F. | 15° F. | 84.6 | 84.7 | 71.6 | 13.9 | 11.6 | 1.4 | 1.2 |
| Hydrodewaxed Sample Day 10.7 | 658° F. | 15° F. | 86.3 | 88 | 75.9 | 10.6 | 9.1 | 1.4 | 1.2 |
| Hydrodewaxed Sample Day 11.7 | 675° F. | 15° F. | 85.4 | 90 | 76.9 | 6.8 | 5.8 | 3.2 | 2.7 |

*Calculated by difference

TABLE D

Analysis of Adelaide Bright Stock and Dewaxed Products From Hydrodewaxing Adelaide Bright Stock Over NiZSM-5 Catalyst $\alpha$ = 70 (5)

| Sample | Temp At Which It Is Obtained °F. | Pour Point °F. | 750° F. + % of Feed | Fraction I: % of 750° F. + Fraction | Fraction I: % of The Feed | Fraction II: % of 750° F. + Fraction | Fraction II: % of The Feed | *Fraction III-V: % of 750° F. + Fraction | *Fraction III-V: % of The Feed |
|---|---|---|---|---|---|---|---|---|---|
| Adelaide Bright Stock | — | 120° F. | 100 | 90.4 | 90.4 | 6.9 | 6.9 | 2.7 | 2.7 |
| Hydrodewaxed Sample Day 1.3 | 570° F. | 20° F. | 85.4 | 90.0 | 76.9 | 9.0 | 7.7 | 1.0 | 0.85 |
| Hydrodewaxed Sample Day 5.5 | 590° F. | 20° F. | 85.7 | 87.5 | 75 | 11.2 | 9.6 | 1.3 | 1.11 |
| Hydrodewaxed Sample Day 12.3 | 620° F. | 20° F. | 85.3 | 89.4 | 76.3 | 9.6 | 8.2 | 1.0 | 0.85 |
| Hydrodewaxed Sample Day 21.3 | 675° F. | 30° F. | 84.9 | 90.0 | 76.4 | 7.8 | 6.6 | 2.2 | 1.9 |

*Calculated by difference

The amounts of Fraction I and Fractions III–V are smaller in the dewaxed products than the feed, while the amount of Fraction II (sulphides) is bigger. In the feed the percent of sulphides is 6.6% while in products it is 9–11.6%. The quantity of sulphides increased during the dewaxing runs, reached a maximum around 620° F. and then decreased. When the run was terminated at 675° F., the content of the sulphide in the feed and product was the same.

The above data indicate that the hydrogenative activity (A) is not constant during the runs. The hydrogenation of the thiophenic compounds is not the only hydrogenation that can take place during dewaxing so the data should be used as an indicator and not as an absolute value.

Fraction I contains the waxes to be removed to reduce the pour point. It can be seen that the percent hydrocracking (B) of this fraction does not change appreciably with time (temperature) in the temperature interval of the dewaxing process. The ratio (A)/(B) changes quite dramatically during dewaxing runs.

Data in Table C indicate that the content of polar compounds (Fractions III–V) is reduced from 2.9% to 1.4% during dewaxing with one exception: the sample outlined at the termination of the run (675° F.) when the concentration of polar compounds remained unchanged. In that sample also no hydrogenative activity of the catalyst was observed. It is possible that the reduction in the concentration of polar compounds is correlated with the hydrogenative activity of the catalyst. This assumption seems to be proved by the following additional data.

We analyzed several samples of dewaxed Adelaide Bright Stock dewaxed isothermally at 675° F. In all the analyzed dewaxed products obtained under these conditions the hydrogenative activity of the catalyst was zero and there was no reduction of the percent of the polar compounds. The only reaction which takes place under these conditions is hydrocracking of all fractions to the same extent.

Thus, in accordance with the invention, changes in the composition of dewaxed material, due to variation in the hydrogenative activity of the hydrodewaxing catalyst, can be detected; and by controlling the hydrogenative activity, using the degree of hydrogenation of thiophenic sulfur as an indicator, the hydrotreating step, subsequent to hydrodewaxing can be eliminated.

What is claimed is:

1. A process for dewaxing a feedstock boiling above about 550° F., and containing thiophenic sulfur components which process comprises a stage of passing the feedstock together with hydrogen over a catalyst composition under conditions equivalent to a pressure of about 400 psig, a maximum temperature of about 620° F. and a maximum space velocity of about 1.0 LHSV, wherein said catalyst composition comprises ZSM-5 and at least one element selected from the group consisting of elements of group VIII of the Periodic Table and elements of Group VI of the Periodic Table of Elements, wherein said at least one element comprises 0.1 to 5 weight percent of said catalyst composition wherein said conditions of temperature and space velocity provide a dewaxed oil exhibiting stability to oxidation, wherein said conditions are maintained to ensure hydrogenation of at least about 10% of thiophenic sulfur components of the feedstock.

2. The process of claim 1, which consists essentially of said stage.

3. The process of claim 1, wherein said at least one element is nickel.

4. The process of claim 1, wherein the LHSV is no greater than about 0.5.

5. The process of claim 1, wherein said stability to oxidation, as measured by ASTM D-943, is at least 1000 hours.

6. The process of claim 1, wherein said maximum temperature is about 600° F. to 610° F.

7. The process of claim 1, wherein the maximum temperature is about 600° F.

8. The process of claim 7, wherein the maximum LHSV is about 0.5.

9. A process of producing a hydrodewaxed feedstock of acceptable pour point specifications and oxidative stability specifications, as measured by ASTM D-943, comprising contacting a feedstock, containing wax components in unacceptable amounts and thiophenic sulfur containing components and boiling above about 550° F., with a catalyst comprising ZSM-5 and at least one element selected from the group consisting of elements of Group VIII and elements of Group VI in the presence of hydrogen at pressure, temperature and LHSV conditions effective to maintain hydrogenation of at least about 10% of said thiophenic sulfur containing components, whereby the resulting hydrodewaxed feedstock exhibits acceptable oxidative stability as measured by ASTM D-943 and whereby the necessity of hydrotreating conditions, subsequent to said hydrodewaxing, to achieve said oxidative stability, is eliminated.

10. The process of claim 9, wherein at a constant pressure of about 400 psig, the maximum temperature is less than about 620° F. and the maximum LHSV is about 1.

11. The process of claim 10, wherein the maximum temperature ranges from about 610°–620° F.

12. The process of claim 10, wherein the maximum temperature is about 600° F.

13. The process of claim 10, wherein the maximum LHSV is about 0.5.

14. The process of claim 9, wherein at a constant pressure of about 400 psig, the maximum temperature ranges from about 610°–620° F.

* * * * *